US010034559B2

(12) United States Patent
Stolarz et al.

(10) Patent No.: US 10,034,559 B2
(45) Date of Patent: Jul. 31, 2018

(54) REFRIGERATED MERCHANDISE DISPLAY SYSTEM

(71) Applicant: PEPSICO, INC., Purchase, NY (US)

(72) Inventors: Christian Stolarz, Brooklyn, NY (US); Praveen Kumar Nooli, Coram, NY (US); Martin Broen, New York, NY (US); Stephen Lim, Chappaqua, NY (US)

(73) Assignee: PEPSICO, INC., Purchase, NY (US)

( * ) Notice: Subject to any disclaimer, the term of this patent is extended or adjusted under 35 U.S.C. 154(b) by 0 days.

(21) Appl. No.: 15/675,326

(22) Filed: Aug. 11, 2017

(65) Prior Publication Data

US 2017/0340139 A1 Nov. 30, 2017

Related U.S. Application Data

(62) Division of application No. 15/058,773, filed on Mar. 2, 2016, now Pat. No. 9,750,355.

(51) Int. Cl.

| | |
|---|---|
| ***A47F 3/00*** | (2006.01) |
| ***A47F 3/04*** | (2006.01) |
| ***F25D 11/00*** | (2006.01) |
| *F24F 13/08* | (2006.01) |
| *F25D 23/02* | (2006.01) |

(52) U.S. Cl.

CPC ..... *A47F 3/0434* (2013.01); *F25D 11/00* (2013.01); *A47F 3/043* (2013.01); *F24F 13/08* (2013.01); *F25D 23/02* (2013.01); *F25D 2317/0671* (2013.01); *F25D 2317/0672* (2013.01)

(58) Field of Classification Search

CPC ..... A47F 3/0426; A47F 3/043; A47F 3/0434; F25D 11/00; F25D 23/00; F25D 23/02; F25D 23/028; F25D 2323/00; F25D 2323/02

See application file for complete search history.

(56) References Cited

U.S. PATENT DOCUMENTS

| | | | | |
|---|---|---|---|---|
| 2,226,444 A | | 12/1940 | Caulk, Jr. | |
| 2,610,473 A | * | 9/1952 | Chovanec ..... | A47F 3/043 312/116 |
| 3,221,636 A | | 12/1965 | Smith et al. | |
| 3,245,224 A | | 4/1966 | Wilkinson | |
| 3,462,996 A | | 8/1969 | Frank | |
| 3,759,059 A | | 9/1973 | Kenyon | |
| 5,056,331 A | | 10/1991 | Lotz | |
| 5,315,842 A | | 5/1994 | Bolton et al. | |
| 5,402,654 A | | 4/1995 | Rudick et al. | |

(Continued)

OTHER PUBLICATIONS

"PepsiCo Global Cooler Platform" (PepsiCo) [online] (retrieved from the internet on Apr. 20, 2017) <URL https://www.good-design.com/entry/pepsico-global-cooler-platform/>, Dec. 16, 2016 (Dec. 16, 2016); entire document.

*Primary Examiner* — Daniel J Rohrhoff

(74) *Attorney, Agent, or Firm* — Sterne, Kessler, Goldstein & Fox, P.L.L.C.

(57) ABSTRACT

A merchandise display system for storing and dispensing merchandise is provided. The merchandise display system includes an outer housing, a transparent front door, a refrigeration unit, and a door that includes an extended canopy. The merchandise display system also includes a front grille for a refrigeration system having a surface adjacent a curved surface.

10 Claims, 10 Drawing Sheets

(56) References Cited

U.S. PATENT DOCUMENTS

| | | | | |
|---|---|---|---|---|
| 5,584,547 | A * | 12/1996 | Trulaske, Sr. | A47F 3/0434 312/114 |
| 6,354,098 | B1 * | 3/2002 | Bardin | A47F 1/12 221/124 |
| 9,750,355 | B1 * | 9/2017 | Stolarz | A47F 3/0434 |
| 2002/0050350 | A1 | 5/2002 | Moretti et al. | |
| 2005/0056037 | A1 | 3/2005 | Park et al. | |
| 2007/0241645 | A1 * | 10/2007 | Trulaske, Sr. | A47F 3/001 312/116 |
| 2009/0084128 | A1 | 4/2009 | Goerz et al. | |
| 2010/0043472 | A1 * | 2/2010 | Iguchi | A47F 3/0426 62/255 |
| 2011/0314855 | A1 | 12/2011 | Yu et al. | |
| 2015/0272345 | A1 | 10/2015 | Bhatia et al. | |
| 2015/0362792 | A1 * | 12/2015 | Dunn | A47F 3/043 349/65 |
| 2015/0366083 | A1 * | 12/2015 | Dunn | G02F 1/133308 349/1 |
| 2016/0169578 | A1 * | 6/2016 | Linney, II | E05B 65/0042 62/56 |
| 2016/0313014 | A1 | 10/2016 | Phillips et al. | |
| 2017/0045240 | A1 | 2/2017 | Choi et al. | |
| 2017/0257956 | A1 * | 9/2017 | An | H05K 5/0017 |
| 2017/0340138 | A1 * | 11/2017 | Nooli | A47B 96/027 |

* cited by examiner

REFRIGERATED MERCHANDISE DISPLAY SYSTEM

CROSS-REFERENCE TO RELATED APPLICATION

This application is a divisional of U.S. application Ser. No. 15/058,773 filed Mar. 2, 2016, which is incorporated herein by reference in its entirety.

BACKGROUND

Field

The invention relates generally to a merchandise display system for storing and dispensing merchandise.

Background

The design and construction of merchandise display systems, including commercial refrigerators, has remained generally unchanged for many years. These display systems are typically large boxes, which have failed to keep up with design trends and consumer expectations. The air openings in the front grille for the commercial refrigerator refrigeration system are typically louvers arranged across a front surface. In addition, transportation of commercial refrigerators can result in damaged or broken components, particularly if the component extends outward from the surface of the main housing.

BRIEF SUMMARY OF THE INVENTION

In one aspect of the invention, the refrigeration compartment cover, i.e., grille, does not include visible vents. In another aspect, a partition on an interior surface of the refrigeration compartment cover can isolate inlet & exhaust air to prevent mixing of hot and cold air streams. Thus, the partition can improve thermal efficiency of the condenser (heat exchanger) and increase available cooling capacity of the refrigeration system (or heating capacity of the heat-pump system).

In one aspect of the invention, a front grille for a refrigeration unit includes an outer portion having a substantially planar surface and a curved surface, an air inlet positioned on a first side of the grille between the substantially planar surface and the curved surface, an air outlet positioned on a second side of the grille between the substantially planar surface and the curved surface, and an interior portion including a partition placed between the air inlet and the air outlet to separate inlet air flowing through the air inlet from outlet air flowing through the air outlet.

In another aspect of the invention, a refrigerated merchandise display system includes a refrigeration unit, an outer housing having a top wall, a bottom wall, side walls, a back wall, and an interior lower wall, where the refrigeration unit is positioned within a refrigeration compartment between the side walls, the back wall, the bottom wall, and the interior lower wall. The outer housing also includes a merchandise compartment positioned between the side walls, the back wall, the top wall, and the interior lower wall, a transparent door positioned across the merchandise compartment, and a refrigeration compartment cover, i.e., grille, positioned across the refrigeration compartment. The grille includes an outer portion having a substantially planar surface and a curved surface, an air inlet positioned on a first side of the grille between the substantially planar surface and the curved surface, an air outlet positioned on a second side of the grille between the substantially planar surface and the curved surface, and an interior portion including a partition placed between the air inlet and the air outlet to separate inlet air flowing through the air inlet from outlet air flowing through the air outlet.

In a further aspect of the invention, a merchandise display system includes an outer housing having a top wall, a bottom wall, side walls, and a back wall, and a door. The door includes a frame surrounding a transparent front surface that includes a top frame having a bracket that extends away from the transparent front surface, a first side frame having a first channel positioned adjacent the top frame, a second side frame having a second channel positioned adjacent the top frame, a bottom frame, and an extended canopy. The extended canopy includes a bottom surface having a recess to engage the bracket, a first member to engage the first channel, and a second member to engage the second channel. The extended canopy is detachably attached to the top frame, the first side, frame, and the second side frame.

Further features and advantages of embodiments of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to a person skilled in the relevant art(s) based on the teachings contained herein.

BRIEF DESCRIPTION OF THE DRAWINGS/FIGURES

The accompanying drawings, which are incorporated herein and form part of the specification, illustrate embodiments of the present invention and, together with the description, further serve to explain the principles of the invention and to enable a person skilled in the relevant art(s) to make and use the invention.

Features and advantages of the embodiments will become more apparent from the detailed description set forth below when taken in conjunction with the drawings, in which like reference characters identify corresponding elements throughout.

DETAILED DESCRIPTION OF THE INVENTION

Figure 1:
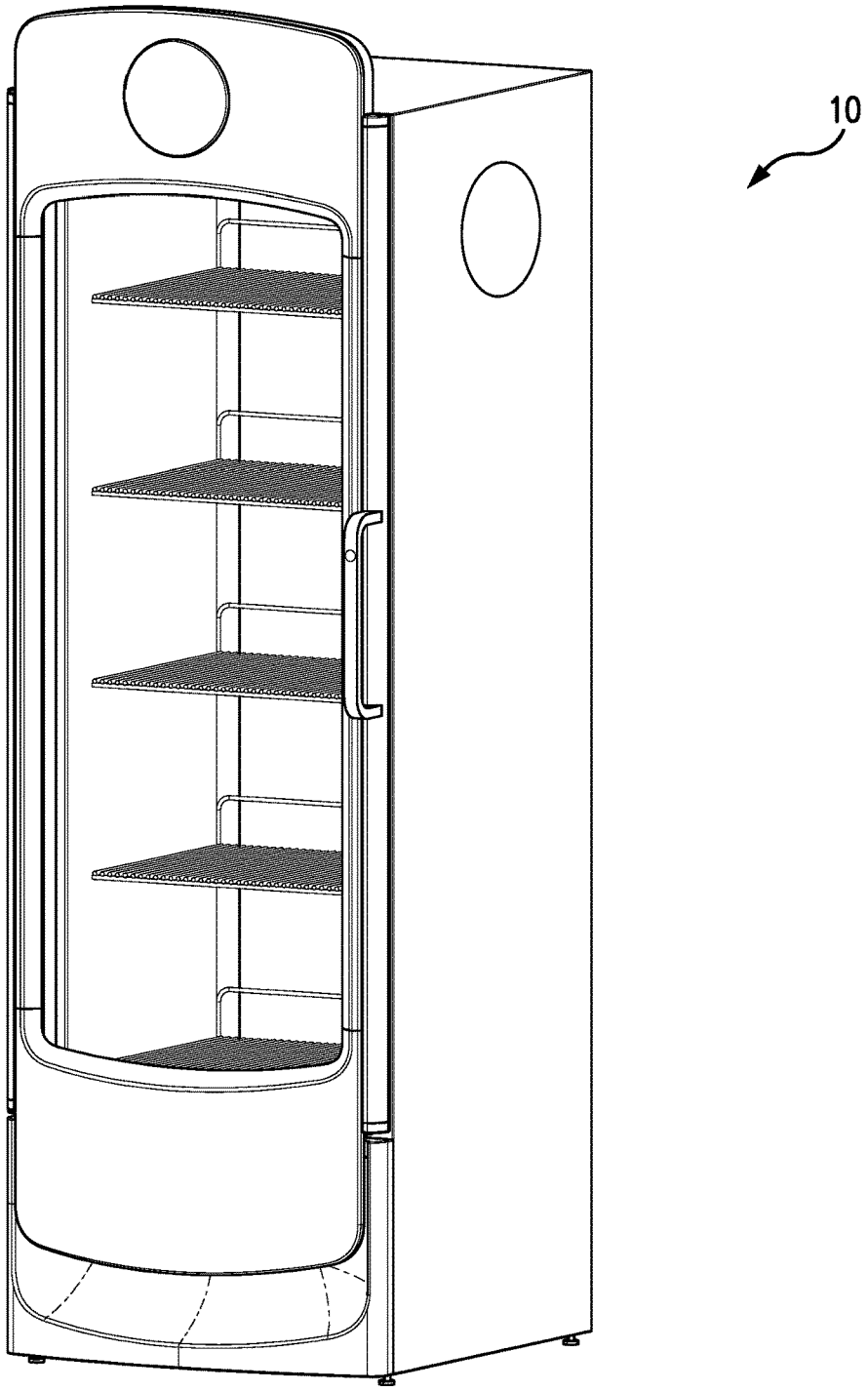
FIG. 1 is a perspective view of a merchandise display system according to various aspects of the invention.
Figure 2:
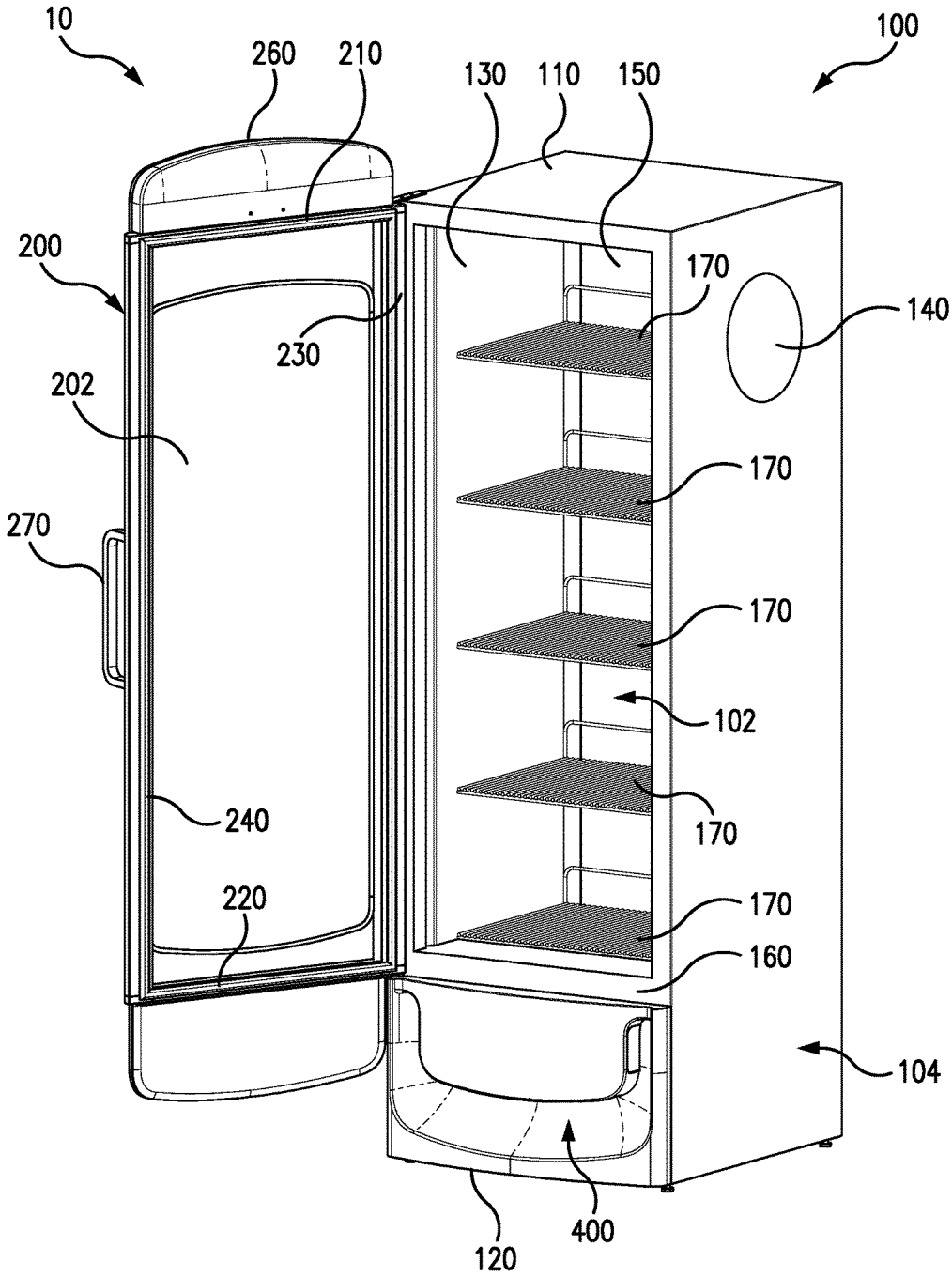
FIG. 2 is a perspective view of a merchandise display system according to various aspects of the invention.
Figure 3:
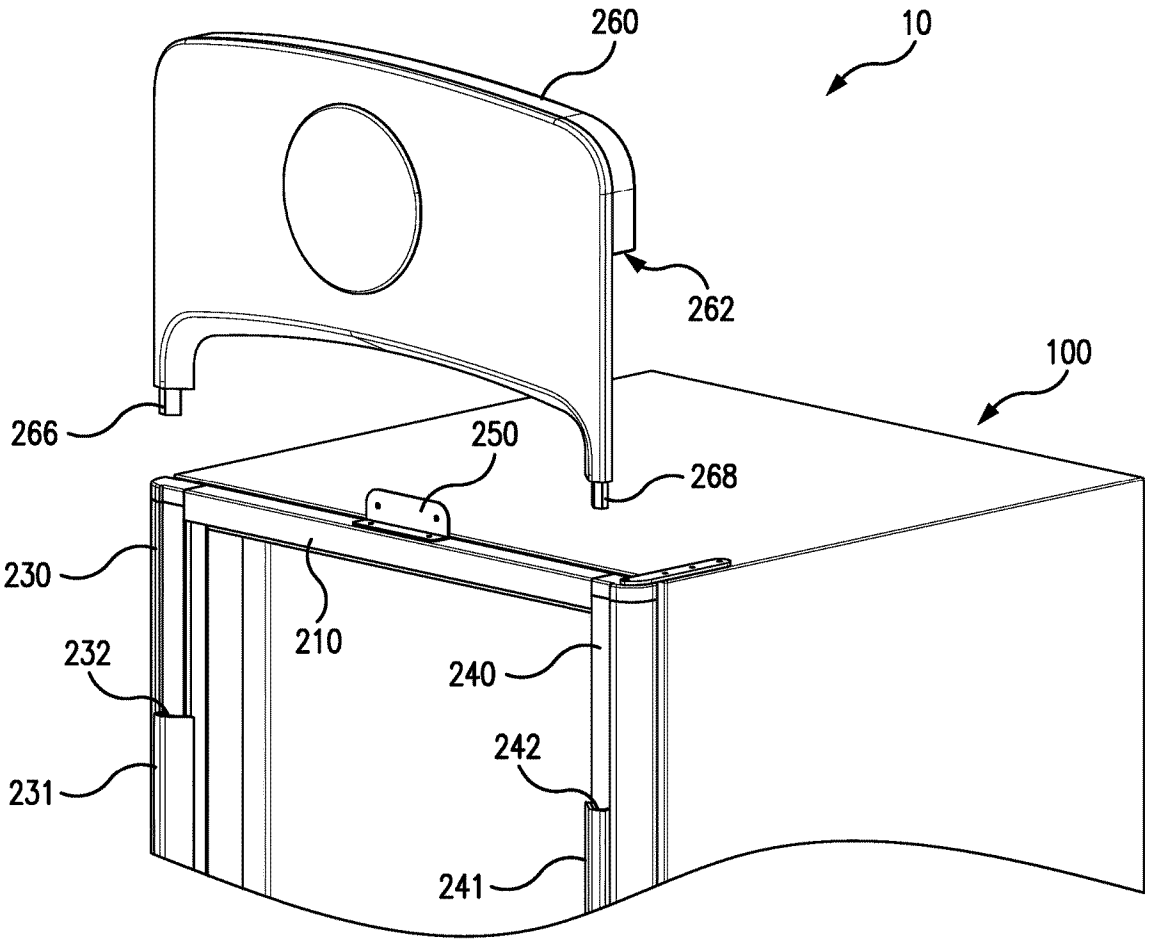
FIGS. 3-5 are partial perspective views of an extended canopy for a merchandise display system according to various aspects of the invention.
Figure 4:
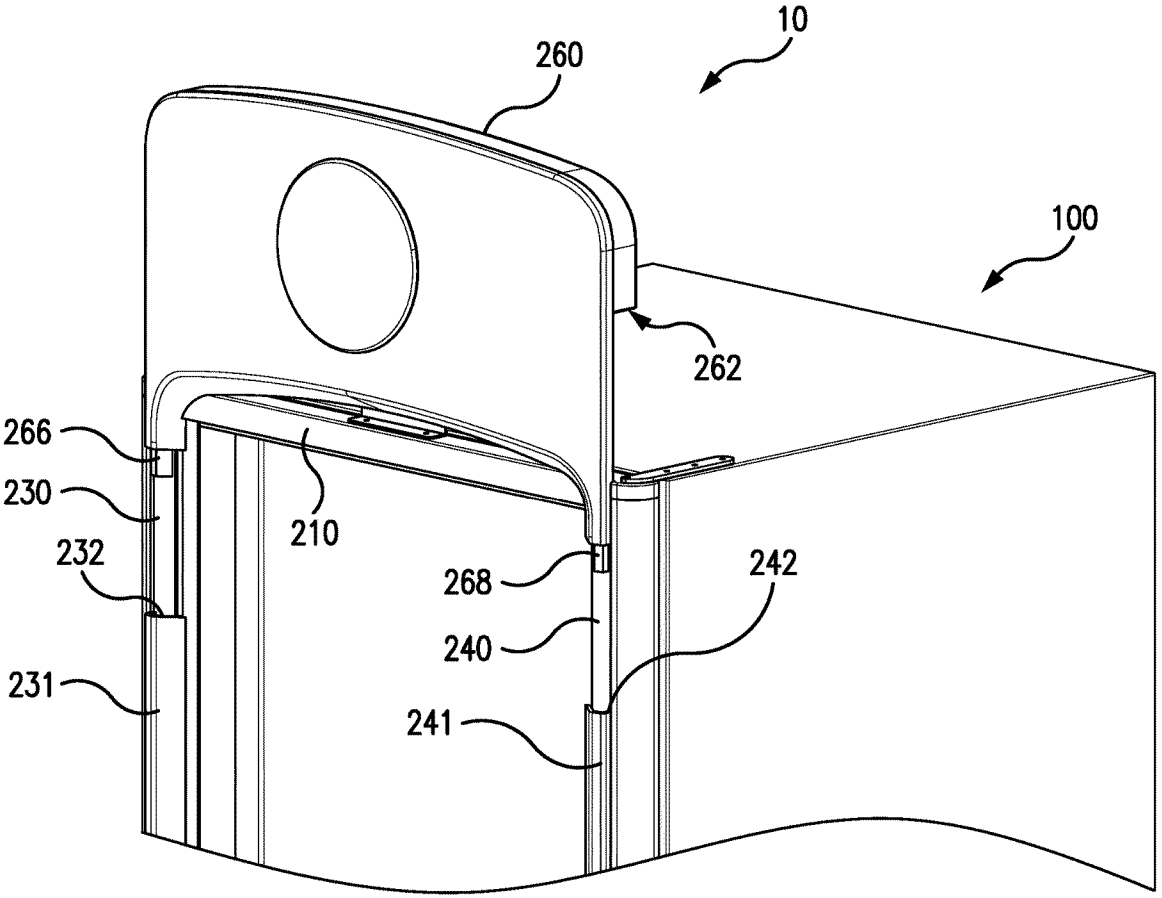
Figure 5:
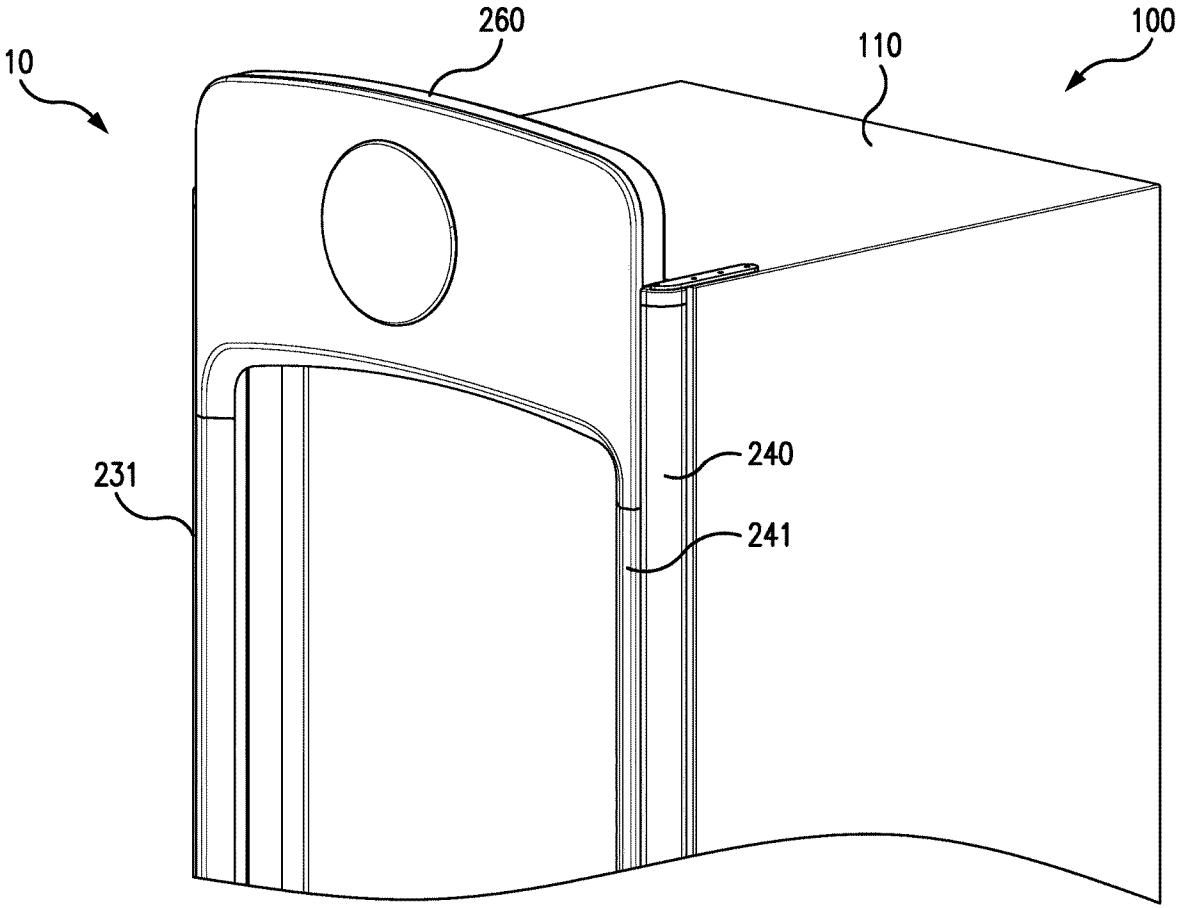

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

An aspect of the present invention will now be described with reference to FIGS. 1-7. Merchandise display system 10 includes an outer housing 100 composed of a top wall 110, a bottom wall 120, side walls 130 and 140, a back wall 150, an interior lower wall 160, and a door 200. The back wall 150, side walls 130 and 140, interior lower wall 160, and top wall 110 define a merchandise compartment 102 in the outer housing 100. The back wall 150, side walls 130 and 140, interior lower wall 160, and bottom wall 120 define a refrigeration compartment 104. Refrigeration compartment 104 may be configured to receive a refrigeration unit 300. The door 200 may include a front surface 202 that can be made of any suitable material, such as glass or plastic. In one aspect, front surface 202 is transparent to allow visual access to the merchandise stored and displayed within the display system 10. Door 200 includes a top frame 210 having a top frame width 212, a bottom frame 220, a side frame 230 having side frame cladding 231, and a side frame 240 having side frame cladding 241. Bracket 250 is attached to a top surface of top frame 210. Top frame 210, bottom frame 220, side frame 230, inside frame 240 surround front surface 202. The door 200 may open in any suitable manner. For example, one side of the door 200 can be hingedly attached to the display system 10 for the door 200 to swing open to allow access to the display system 10. Alternatively, the door 200 may slide open. Door 200 includes a handle 270 for opening the door 200.

The outer housing 100 may be any shape or size suitable for cooling and displaying merchandise. For example, the outer housing 100 may be generally rectangular or box shaped and may include curved or rounded surfaces. The outer housing 100 may be manufactured in a variety of colors. The color of the outer housing 100 may be indicative of a certain brand or type of merchandise and may be used to promote the brand or type of merchandise. For example, blue and red may be used to promote traditional Pepsi products; white and blue may be used to promote Diet Pepsi products; green may be used to promote non-carbonated beverages; and orange and may be used to promote Gatorade products.

Merchandise display system 10 may include a plurality of shelves 170, which are configured to hold and display merchandise. The plurality of shelves 170 may be attached to and supported by and inner structure that can include grooves, ridges, holes, or other attachment features. The plurality of shelves 170 may be made of any suitable material. For example, the plurality of shelves 170 may be made of plastic or metal. The plurality of shelves 170 may be a solid surface or may include apertures to allow air, liquid and debris to flow through. Any number of shelves 170 is contemplated within the scope of the invention, and may be dependent on the height of the merchandise within the merchandise display system 10.

As shown in FIGS. 2-7, extended canopy 260 can be attached to door 200. Extended canopy 260 can provide additional design and branding areas for merchandise display system 10. Because extended canopy 260 extends above top wall 110 of outer housing 100, extended canopy 260 could be damaged or broken during shipment or transport of merchandise display system 10. Thus, extended canopy 260 is easily removable for transport and later assembly at the point of sale.

In an aspect of the invention, first channel 232 is formed between side frame 230 and side frame cladding 231 on door 200. Second channel 242 is formed between side frame 240 and side frame cladding 241. Extended canopy 260 includes first member 266 that engages first channel 232 and second member 268 that engages second channel 242. Extended canopy 260 can engage door 200 via a snap fit such that first member 266 and/or second member 268 can be a cantilever beam having an overhang, that engages a respective slot in side frame cladding 231 and/or side frame cladding 241 or side frame 230 and/or side frame 240.

Extended canopy 260 can include a bottom surface 262 having a bottom surface width 263. In one aspect of the invention, bottom surface 262 is adjacent to a top surface of top frame 210. Bottom surface width 263 can be approximately equal to top frame width 212 to present a uniform appearance.

Figure 6:
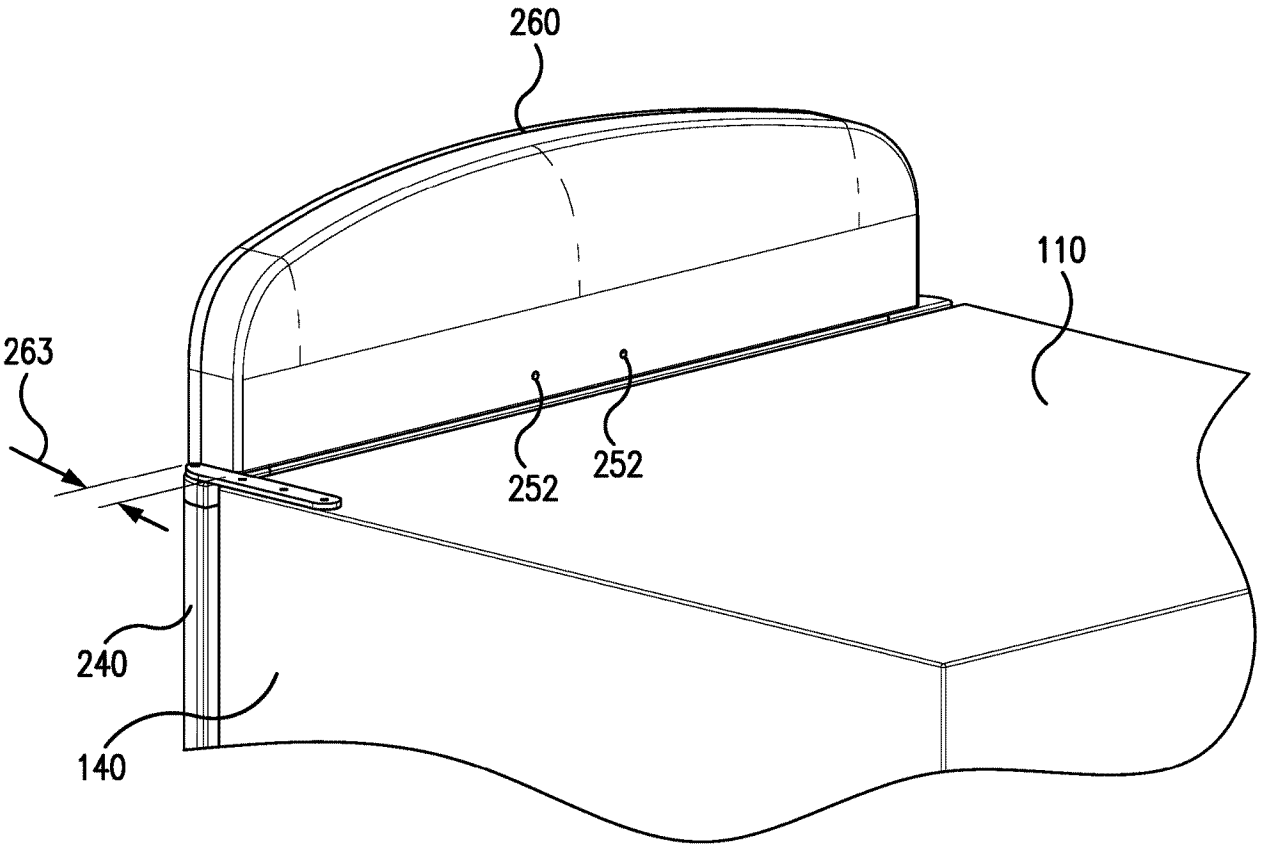
FIGS. 6-7 are rear partial perspective views of an extended canopy for a merchandise display system according to various aspects of the invention.
Figure 7:
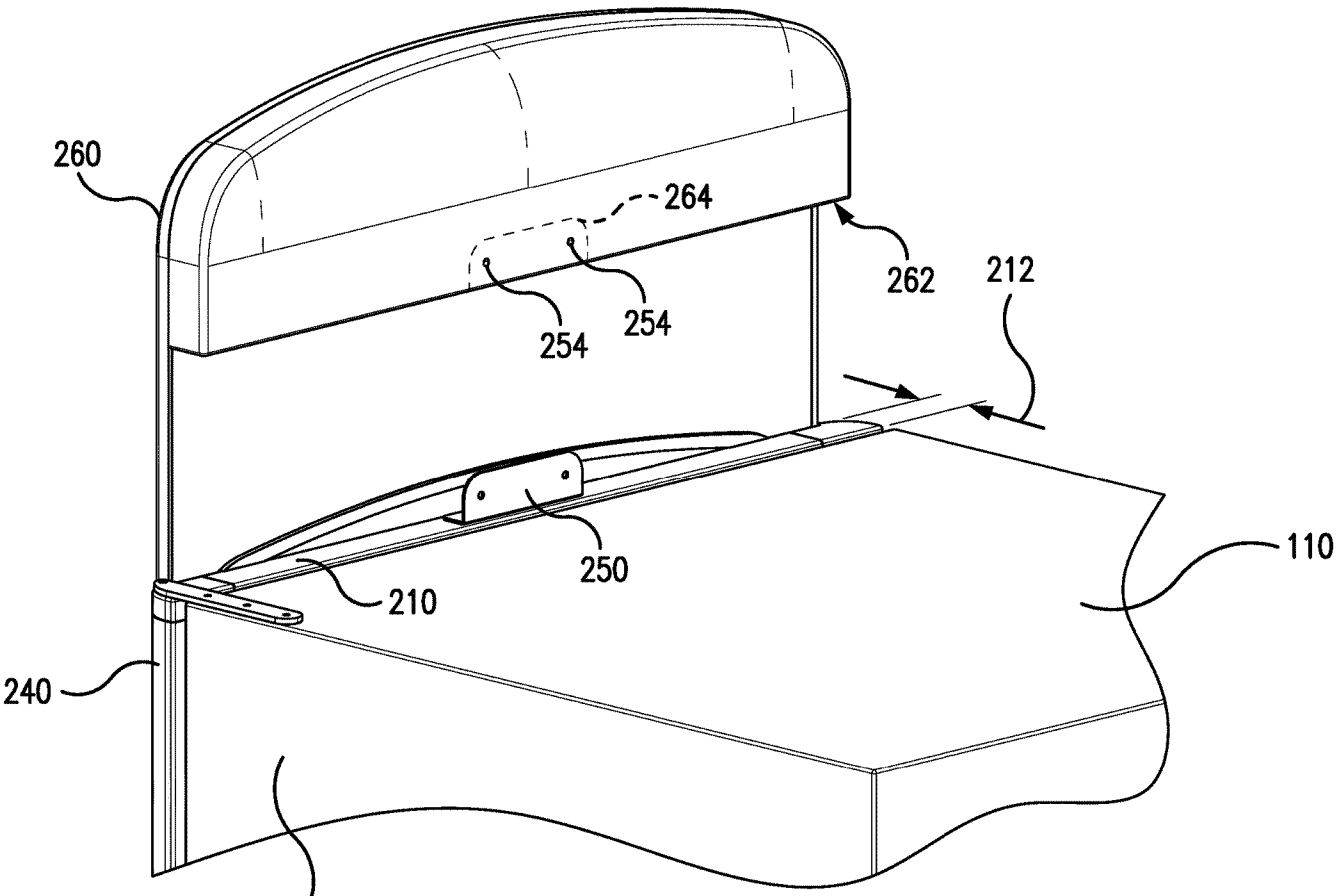

As shown in FIGS. 6-7, a rear surface 261 of canopy 260 can be attached to a bracket 250 with fasteners 252. Fasteners 252 can be screws, bolts, rivets, nails, or any suitable fastener known in the art. Extended canopy 260 can include a recess 264 in bottom surface 262 to receive bracket 250 entirely within extended canopy 260.

In one aspect of the invention, all or portions of the merchandise display system 10 may be shipped as component pieces and assembled at a merchandising location. Each of the components of the display system 10 may be separate from each other and attached together to form the display system 10.

The merchandise display system 10 may include logos or signs to further promote the brand or type of merchandise within the merchandise display system 10. The logos and signs may be place on any suitable surface of the merchandise display system 10. For example, a sign may be placed on the top wall 110 of the outer housing 100 or logos may be attached to the door 200, side walls 130 or 140, or extended canopy 260.

The refrigeration unit 300 (not shown) can include typical refrigeration components such as a compressor, a condenser, an evaporator, a fan, etc. The refrigeration unit 300 can operate on a conventional vapor compression to maintain the beverages or merchandise at a desired temperature. In the vapor compression cycle, the refrigerant in the vapor phase is compressed in a compressor resulting in an increase in temperature and pressure. Next, the hot, high-pressure refrigerant is circulated through a heat exchanger—a condenser—where it is cooled by heat transfer to the surrounding air. Because of the heat transfer to the surrounding air, the refrigerant condenses back to a liquid from the gas phase. The refrigerant then passes through a throttling device that reduces the pressure and temperature of the refrigerant. The cold refrigerant leaves the throttling device and enters a second heat exchanger—an evaporator—that provides cooled air to the area to be refrigerated. Heat transfer between the evaporator and area to be refrigerated causes the refrigerant to evaporate or change from a saturated mixture of liquid and vapor into a superheated vapor. The vapor leaving the evaporator is then drawn back into the compressor to repeat the cycle.

The refrigeration unit 300 can use any suitable type of refrigerant to cool the merchandise display system 10. For example, R134A (tetraflouroethane), $CO_2$ (carbon dioxide), or hydrocarbons may be used. The refrigeration components of refrigeration unit 300 can be placed within refrigeration compartment 104 and separated as necessary by insulating material. Alternatively, some of the refrigeration components may be placed in separate enclosures within the refrigeration compartment 104. A front grille 400 can cover the front surface of the refrigeration compartment 104. In one aspect of the invention, a portion of door 200 can cover a portion of front grille 400.

Figure 8:
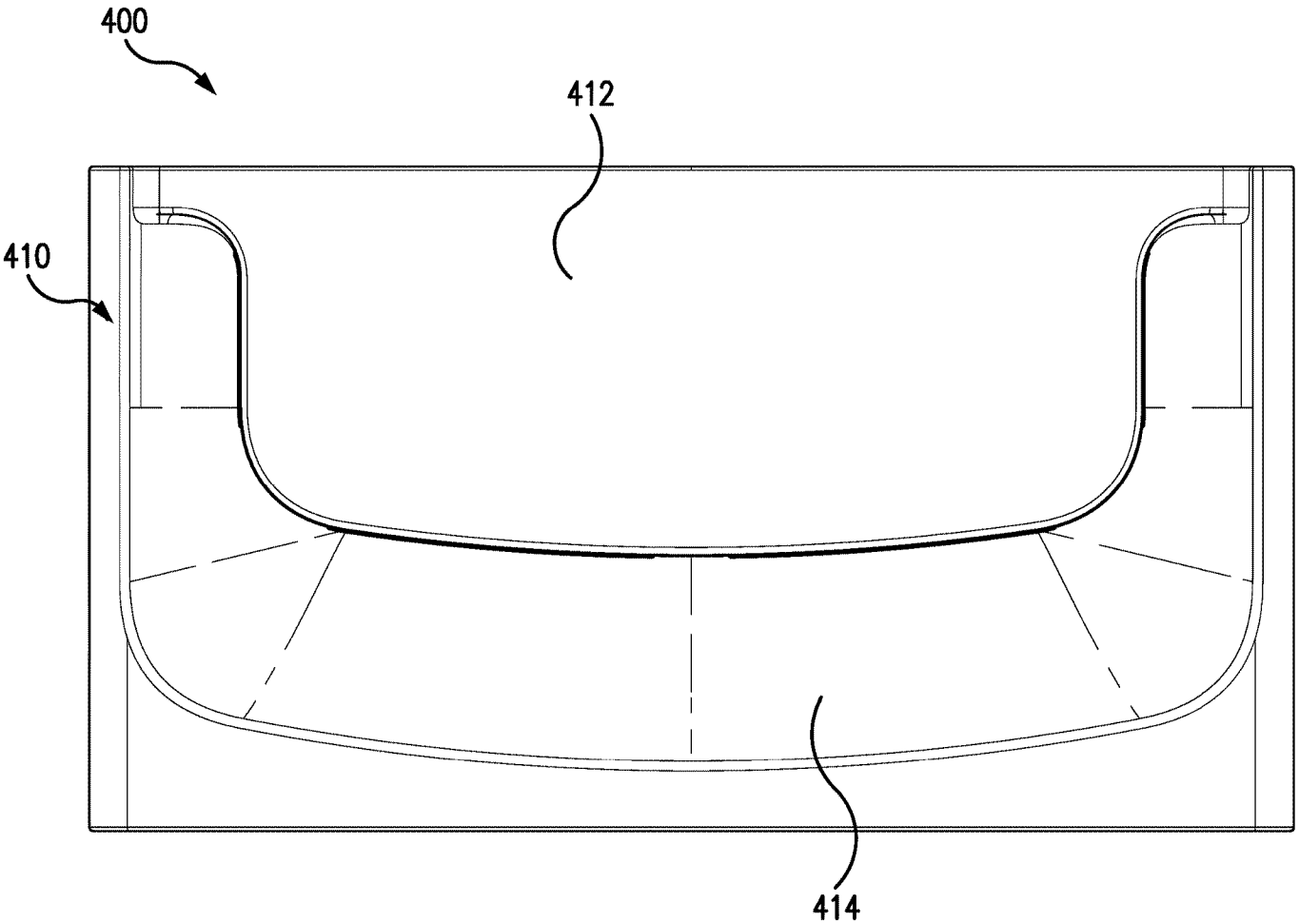
FIG. 8 is a partial front view of a front grille according to various aspects of the invention.
Figure 9:
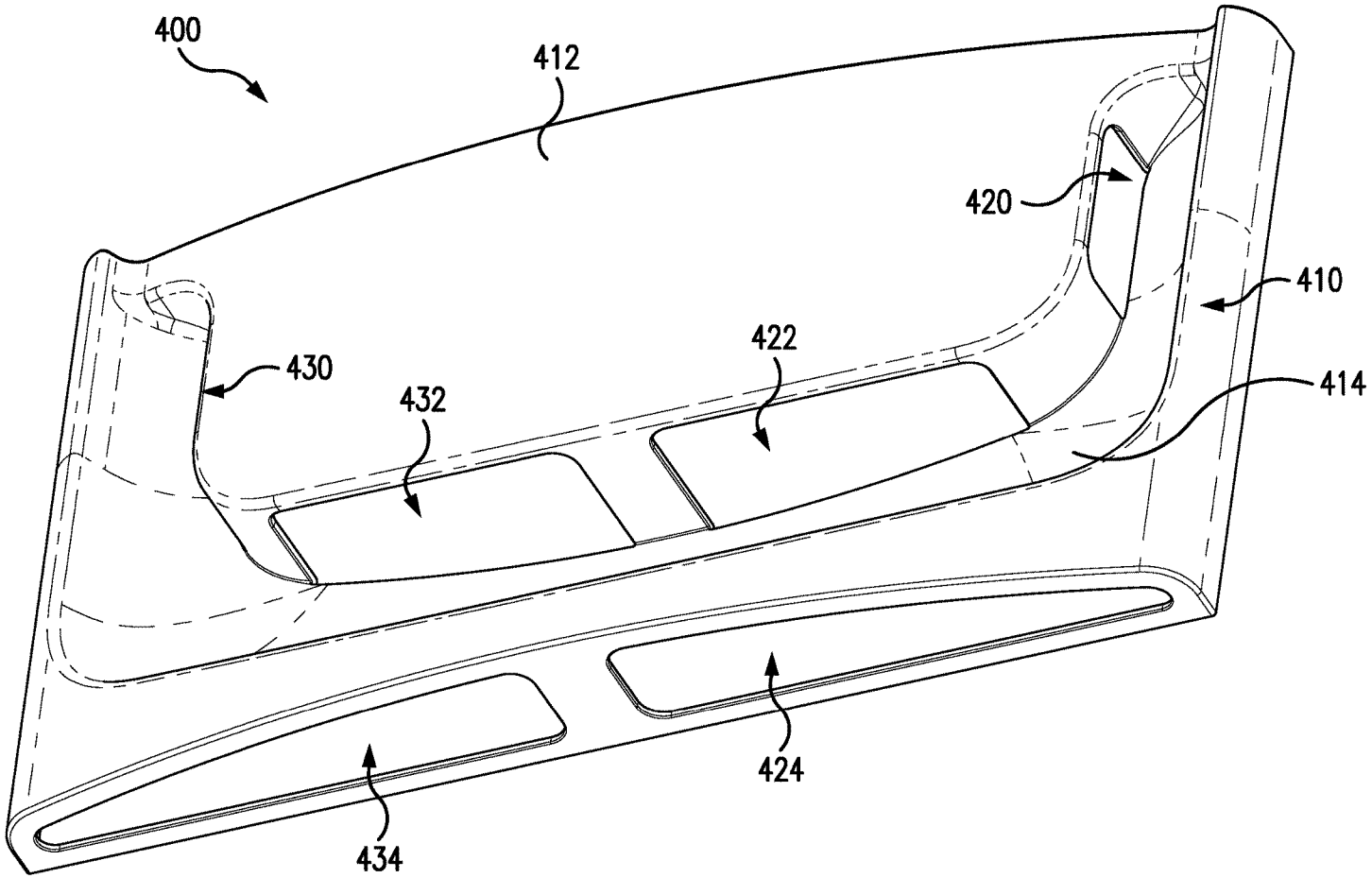
FIG. 9 is a perspective view of a front grille according to various aspects of the invention.
Figure 10:
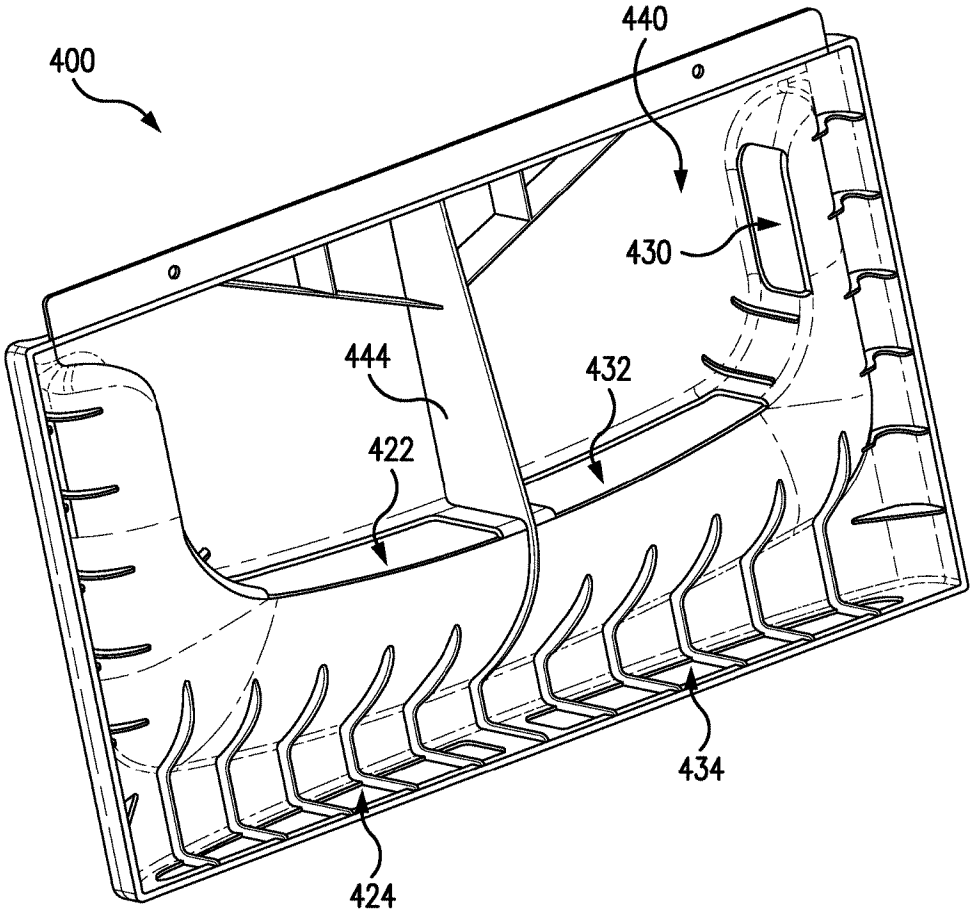
FIG. 10 is a rear perspective view of a front grille according to various aspects of the invention.

As shown in FIGS. 8-10, front grille 400 includes a surface 412 and a curved surface 414. In one aspect of the invention, surface 412 is substantially planar or flat. Alternatively, surface 412 can be curved from left to right and/or from top to bottom. In an aspect of the invention, curved surface 414 can extend along a left side portion, bottom portion, and right side portion of surface 412.

The curved surface 414 can become tangential to the plane that is parallel to surface 412. This acts like an air plenum that directs airflow into and out of the system. In one aspect of the invention, the depth of the front surface 412 to the lower edge of curved surface 414 can be approximately two inches. In another aspect, the depth of the front surface 412 to the lower edge of curved surface 414 can range from approximately ¼ inch to approximately four inches. In a further aspect, the depth of the front surface 412 to the lower edge of curved surface 414 can be greater than approximately ½ inch. In another aspect, the radius of curvature on curve surface 414 can be optimized to reduce airflow resistance to guide streamlines of air into the compressor compartment, and vice-versa for exit air.

Front grille 400 can be arranged so that the air inlets and air outlets are not visible when viewing merchandise display system 10 from the front. Front grille 400 can include one or more air inlets and one or more air outlets. For example, front grille 400 can include air inlets 420, 422, and 424, and air outlets 430, 432, and 434.

Air inlets 420, 422, 424 and/or air outlets 430, 432, 434 can be positioned between surface 412 and curved surface 414. In one aspect of the invention, air inlet 420, 422, and 424 are substantially perpendicular to surface 412. In another aspect, air outlets 430, 432, and 434 are substantially perpendicular to surface 412. In an alternate aspect, air inlets 420, 422, 424 and/or air outlets 430, 432, and 434 can be angled with respect to surface 412. For example, air inlets 420, 422, 424 and/or air outlets 430, 432, and 434 can be angled from approximately zero degrees to approximately 90 degrees with respect to surface 412.

In one aspect of the invention, the depth of each of air inlets 420, 422, and 424 and/or air outlets 430, 432, and 434 can be approximately two inches. In another aspect, the depth of each of air inlets 420, 422, and 424 and/or air outlets 430, 432, and 434 can range from approximately ¼ inch to approximately four inches. In a further aspect, the depth of each of air inlets 420, 422, and 424 and/or air outlets 430, 432, and 434 can be greater than approximately ½ inch. In one aspect of the invention, the area of each of air inlets 420, 422, and 424 can range from approximately one square inch to approximately 20 square inches. For example, the area of each of air inlets 420, 422, and 424 can be approximately nine square inches. In another aspect, the combined area of air inlets 420, 422, and 424 can be approximately 23.5 square inches. In another aspect, the area of each of air outlets 430, 432, and 434 can range from approximately three square inches to approximately 20 square inches. For example, the area of each of air outlets 430, 432, and 434 can be approximately nine square inches. In another aspect, the combined area of air outlets 430, 432, and 434 can be approximately 23.5 square inches. In a further aspect, the total airflow inlet area and/or the total airflow outlet area can be approximately 39 square inches.

Front grille 400 also includes an inner portion 440, as shown in FIG. 10. A partition 444 is formed on inner portion 440 to separate inlet air flowing through one or more of air inlets 420, 422, and 424 from outlet air flowing through one or more of air outlets 430, 432, and 434. Partition 444 can be approximately perpendicular to surface 412. In a further aspect, partition 444 can be angled from approximately zero degrees to approximately 90 degrees with respect to surface 412. In another aspect, partition 444 can be approximately parallel to air inlet 420 and air outlet 430. Partition 444 can also be approximately perpendicular to air inlets 422 and 424 and air outlets 432 and 434. In another aspect the inner portion 440 can be designed to create an airflow plenum surface to smoothly direct airflow from the inlet vents to the refrigeration compartment or condenser (heat exchanger) inlet. Similar design could be implemented on surface 440 for outlet vents. The airflow plenum can be integrated into the 440 geometry and manufactured along with the rest of the grille, or added as an additional component during assembly.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A merchandise display system, the display system comprising:

an outer housing having a top wall, a bottom wall, side walls, and a back wall; and a door, the door including:

a frame surrounding a front surface, the frame including:

a top frame;

a first side frame having a first channel positioned adjacent the top frame;

a second side frame having a second channel positioned adjacent the top frame; and a bottom frame, and an extended canopy, the extended canopy including:

a bottom surface;

a first member to engage the first channel; and a second member to engage the second channel;

wherein the extended canopy is detachably attached to the top frame, the first side frame, and the second side frame.

2. The merchandise display system of claim 1, wherein the extended canopy extends above the top wall of the outer housing.

3. The merchandise display system of claim 1, wherein a width of the bottom surface is approximately equal to a width of a top surface of the top frame.

4. The merchandise display system of claim 1, wherein the first member is a cantilever beam having an overhang on its end to engage a slot in the first channel.

5. The merchandise display system of claim 1, wherein the front surface is transparent.

6. The merchandise display system of claim 1, wherein the frame includes a bracket that extends away from the front surface, and wherein the bottom surface includes a recess to engage the bracket.

7. The merchandise display system of claim 6, wherein a fastener detachably attaches the extended canopy to the bracket.

8. The merchandise display system of claim 1, further comprising:

a second extended canopy, the second extended canopy including:

a top surface;

a third member to engage a third channel in the first side frame positioned adjacent the bottom frame; and a fourth member to engage a fourth channel in the second side frame positioned adjacent the bottom frame;

wherein the second extended canopy is detachably attached to the bottom frame, the first side frame, and the second side frame.

9. The merchandise display system of claim 8, wherein a width of the top surface is approximately equal to a width of a bottom surface of the bottom frame.

10. The merchandise display system of claim 8, wherein the frame includes a second bracket that extends away from the front surface, and wherein the top surface includes a recess to engage the second bracket.

* * * * *